US005363740A

United States Patent [19]

Coakley

[11] Patent Number: 5,363,740

[45] Date of Patent: Nov. 15, 1994

[54] FLUID MOTOR/PUMP WITH SCAVENGED CASE

[75] Inventor: Kim L. Coakley, Camarillo, Calif.

[73] Assignee: Pneumo Abex Corporation, Kalamazoo, Mich.

[21] Appl. No.: 93,496

[22] Filed: Jul. 16, 1993

[51] Int. Cl.[5] ..... F01B 3/00

[52] U.S. Cl. ..... 91/499; 417/204; 417/205; 417/269

[58] Field of Search ..... 417/272, 269, 204, 205; 92/86; 91/499

[56] References Cited

U.S. PATENT DOCUMENTS

| | | | |
|---|---|---|---|
| 3,006,284 | 10/1961 | Pitt et al. | 92/86 X |
| 3,796,522 | 3/1974 | Oshima et al. | 417/269 A X |
| 3,954,353 | 5/1976 | Mokesch | 417/269 |
| 4,205,947 | 6/1980 | Ruhl | 417/205 X |
| 5,118,251 | 6/1992 | Saulgeot | 417/205 X |

*Primary Examiner*—Richard E. Gluck
*Attorney, Agent, or Firm*—Renner, Otto, Boisselle & Sklar

[57] ABSTRACT

A fluid device (pump or motor) comprises a case having a closed chamber, a rotating element mounted for rotation within the closed chamber, a reciprocating piston drivingly connected to the rotating element such that rotation of the rotating element corresponds to reciprocating movement of the piston, passages for admitting and discharging fluid to and from a cylinder in which the piston reciprocates, and scavenger pump means drivingly connected to the rotating element and operable to pump fluid out of the closed chamber at a rate greater than the rate at which fluid leaks or otherwise is metered into the interior chamber, thereby to maintain the level of fluid within the closed chamber below a predetermined level.

20 Claims, 3 Drawing Sheets

FLUID MOTOR/PUMP WITH SCAVENGED CASE

The invention herein described relates generally to fluid motors and pumps and, more particularly, to rotating piston pumps and motors wherein a piston group rotates within a closed chamber in a case containing hydraulic fluid.

BACKGROUND

Rotating fluid pumps and motors, and especially rotating piston pumps and motors, are well known in the prior art. The pumps are often used in hydraulic systems to provide fluid power to components such as hydraulic cylinders and rotary actuators. The fluid motors are often used to provide mechanical power to components such as electrical generators.

Rotary piston pumps and motors are characterized by a rotating piston group and associated swash plate. In a typical arrangement, a plurality of pistons are carried in a barrel that is rotatably mounted in a case. The pistons project from an axial end of the barrel for engagement with the swash plate. In a pump, the barrel is rotatably driven as by means of an input shaft coupled thereto. When the barrel rotates, the pistons are reciprocated back and forth within respective cylinders in the barrel through interaction with the swash plate that is tilted to the axis of the barrel. The piston cylinders are sequentially connected to inlet and outlet passages such that the reciprocating movement of the pistons draws fluid into the cylinder from an inlet passage and pushes the fluid out through an outlet passage.

A rotary piston motor operates generally in reverse manner. The cylinders in the barrel are sequentially connected to a hydraulic fluid supply and return. When the pistons are axially driven by fluid pressure against the tilted swash plate, a reactionary torque is applied to the barrel thereby to rotate the barrel and in turn an output shaft.

In such pumps and motors, windage losses arise when the pump/motor case is filled with hydraulic fluid. Hydraulic fluid may leak from the rotating piston group thereby pressurizing the case and causing fluid flow out of a case drain port and back to the reservoir of the hydraulic system. It is desirable to scavenge the pump-/motor case to reduce windage losses and thereby increase efficiency of the pump or motor. Although the benefits of scavenging the case have long been known, this has not been successfully implemented in a closed hydraulic system where the case is not directly vented to atmosphere. Accordingly, there exists a need for a pump and/or motor that obtains the benefits of a scavenged case in a closed hydraulic system where the case is not directly vented to atmosphere. Moreover, the solution should be such that air is not ingested into the hydraulic system due to a dynamic seal or seals being subjected to low scavenge pressure in the case.

SUMMARY OF THE INVENTION

The present invention provides a fluid device, either in the form of a pump or motor, wherein windage losses arising from rotation of a rotating element within a closed case are minimized or eliminated by scavenging the case. Provision also is made to prevent ingestion of air into the case. Generally, the fluid device is provided with a scavenger pump having a discharge flow capability greater than the rate at which hydraulic fluid flows into the case, as by leakage. This reduces the pressure in the case and causes air in the hydraulic fluid to come out of solution and collect in the case. As the pressure in the case decreases, the efficiency of the scavenger pump decreases until the flow rate of the scavenger pump equals the rate of flow of hydraulic fluid into the case, with the result being a reduction of the level of fluid and pressure in the scavenged case thereby to eliminate or reduce windage losses arising from the rotating element otherwise having to rotate through hydraulic fluid filling the case. A check valve may be provided in the case drain passage to prevent fluid from filling the case during periods when the device is not operating. Ingestion of air into the hydraulic system may be prevented by incorporation of the fluid device into a package without dynamic seals or locating dynamic seals in high pressure regions of the case.

Accordingly, a fluid device according to the invention comprises a case having a closed chamber, a rotating element mounted for rotation within the closed chamber, a reciprocating piston drivingly connected to the rotating element such that rotation of the rotating element corresponds to reciprocating movement of the piston, means for admitting and discharging fluid to and from a cylinder in which the piston reciprocates, means for admitting fluid into the closed chamber at a first rate, and scavenger pump means drivingly connected to the rotating element and operable to pump fluid out of the closed chamber at a second rate greater than the first rate, thereby to maintain the level of fluid within the closed chamber below a predetermined level.

In a preferred embodiment, wherein a shaft connected to the rotating element extends through an opening in a wall of the case, the scavenger pump is located between the closed chamber and the opening in the wall of the case with the opening on an outlet side of the scavenger pump and the closed chamber on an inlet side of the scavenger pump. The rotating element includes a barrel having a plurality of cylinders in which respective pistons are mounted for reciprocating movement, and the pistons have means such as piston shoes or the like for engaging a swash plate member. Preferably the case has a sump at the bottom of the closed chamber for collecting a quantity of the fluid, and a fluid passage is provided to connect the sump to an inlet of the scavenger pump.

Further in accordance with the invention, the fluid device may be packaged with another device such as an electrical device in master-slave relationship therewith to avoid the need for dynamic seals between a connecting drive shaft and respective cases of the devices. The electrical device, such as a generator or motor, includes a stator and rotor enclosed within the confines of the closed chamber, thereby to avoid the need for a dynamic seal exposed at one side to atmospheric pressure.

According to a more specific application of the invention, a fluid pump according to the invention comprises a case having a closed chamber, a rotating element mounted for rotation within the closed chamber, a drive shaft connected to the rotating element, a reciprocating piston drivingly connected to the rotating element such that rotation of the rotating element corresponds to reciprocating movement of the piston within a cylinder, means for admitting and discharging fluid to and from the cylinder in which the piston reciprocates, means for admitting fluid into the closed chamber at a first rate, and scavenger pump means drivingly connected to the rotating element and operable to pump fluid out of the closed chamber at a second rate greater than the first rate, thereby to maintain the level of fluid within the closed chamber below a predetermined level.

According to another specific aspect of the invention, a fluid motor according to the invention comprises a case having a closed chamber, a rotating element mounted for rotation within the closed chamber, an output shaft connected to the rotating element, a reciprocating piston drivingly connected to the rotating element such that reciprocating movement of the piston effects rotation of the rotating element, means for admitting and discharging fluid to and from a cylinder in which the piston reciprocates for effecting reciprocating movement of the piston, means for admitting fluid into the closed chamber at a first rate, and scavenger pump means drivingly connected to the rotating element and operable to pump fluid out of the closed chamber at a second rate greater than the first rate, thereby to maintain the level of fluid within the closed chamber below a predetermined level.

The invention also provides a novel method for scavenging the case of a fluid device.

The foregoing and other features of the invention are hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION

In order to gain a clear understanding of the novel principles of the invention, the invention initially will be described in relation to a prior art rotating piston pump that is available from Abex Aerospace of Oxnard, Calif. under Model No. AP19V-19. This prior art pump in pertinent part is illustrated in FIG. 1, whereas an adaptation of such pump in accordance with the present invention is illustrated in FIG. 2.

Figure 1:
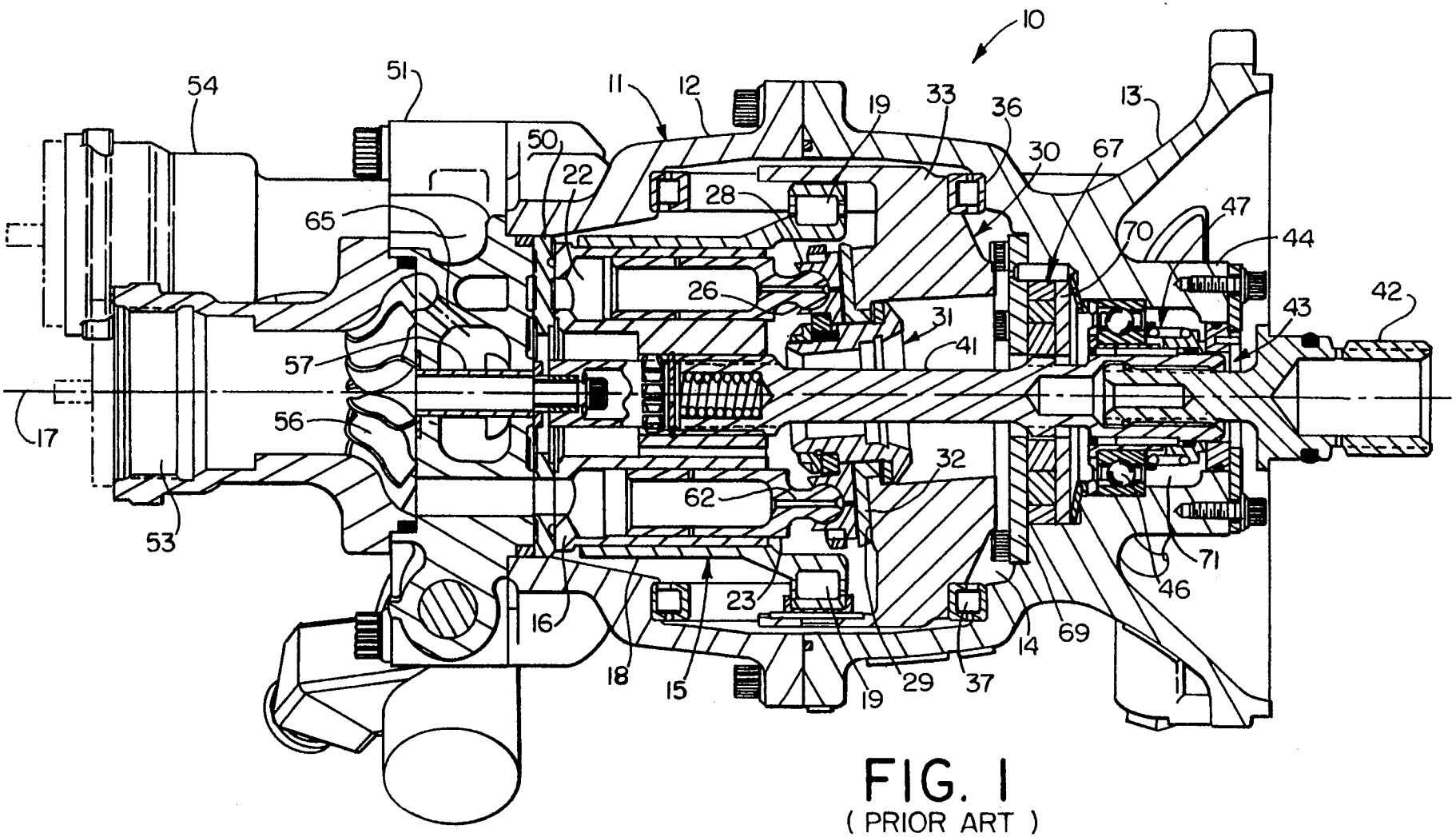
FIG. 1 ( PRIOR ART )
FIG. 1 is a cross-sectional view of a prior art variable displacement rotating piston pump.
Figure 2:
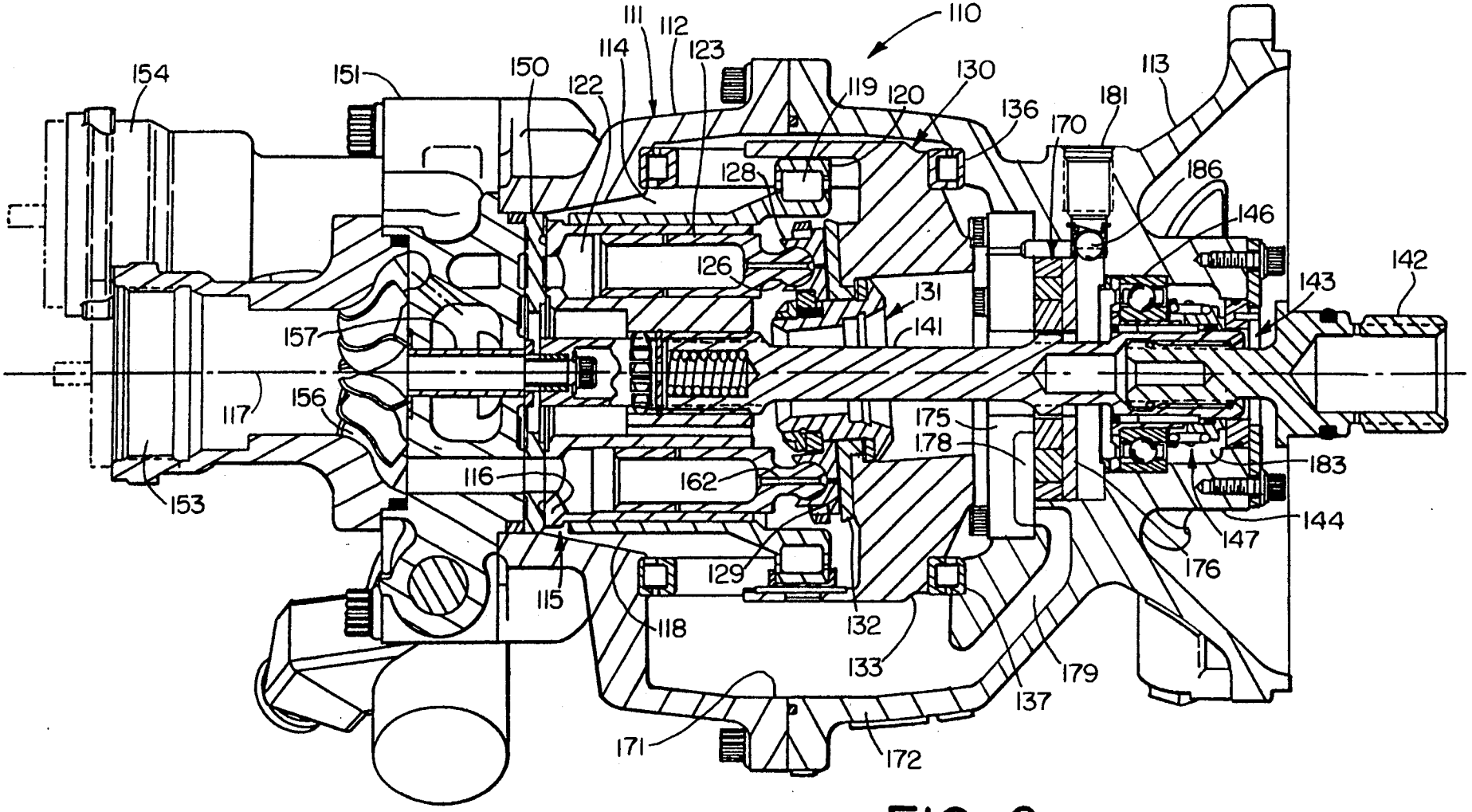
FIG. 2 is a cross-sectional view of a variable displacement rotating piston pump according to a preferred embodiment of the present invention.

Prior Art Rotating Piston Pump (FIG. 1)

With reference to FIG. 1, a prior art variable displacement rotating piston pump is indicated generally at 10. The pump 10 comprises a case 11 which has a front section 12 and a rear section 13. The front and rear sections define therebetween a closed interior chamber 14 in which a rotating group 15 is located.

The rotating group 15 includes a barrel 16 that is mounted within the case 11 for rotation about its center axis 17 by suitable means. The barrel is rotatably supported by the inner race 18 of a roller bearing 19 mounted in the case 11.

The barrel 16 has formed therein a circumferential arrangement of bores 22 that form cylinders for reciprocating pistons 23. As shown, the axes of the cylinders 22 and pistons are parallel to the rotational axis 17 of the barrel. The rear ends of the pistons 23 have balls 26 which are received in sockets of shoes 28, whereby the shoes can swivel relative to the pistons. The piston shoes 28 are held to an end face 29 of a swash plate 30 by a retainer assembly 31. In the pump 10, the swash plate is formed by a wear plate 32 supported on a hanger 33. The wear plate 32 is retained against the front end of the hanger by the retainer assembly 31.

The hanger 33 is mounted in the case 11 by a pair of trunnion bearings 36 and 37. The trunnion bearings prevent the hanger from rotating with the rotating group 15 while enabling the hanger to swivel about an axis perpendicular to the rotation axis 17 of the rotating group 15. The cant or tilt of the hanger, or more particularly the end face 29 of the swash plate 30, is controlled by a stroking piston that is not shown because it is offset from the plane of the cross-section shown in FIG. 1.

The swash plate 30 has a center through passage through which a drive shaft 41 extends coaxially with the barrel 16. The drive shaft 41 is connected to the barrel 16 and extends through an opening 43 in the rear end wall 44 of the case. The drive shaft is rotatably supported by a bearing 46 and the opening 43 is closed and sealed with respect to the drive shaft by a seal 47. The seal 47 is formed by an assembly of parts that provide a dynamic seal between the case and the rotating shaft. At its outer end the drive shaft is provided with a drive coupling 42 that forms a continuation of the drive shaft and provides for connection to an external device such as a motor.

At the other end of the case 11 opposite the drive shaft 41, there is provided a port plate 50 and a manifold 51 which directs the flow of hydraulic fluid between the piston cylinders 22 in the barrel and an inlet 53 and outlet 54. More particularly, the passages in the port plate and manifold direct hydraulic fluid from the inlet 53 to each cylinder during the expansion stroke of the associated piston and from the cylinder to the outlet 54 during the contraction stroke of the piston, thereby to effect pumping of hydraulic fluid from the inlet to the outlet. As shown, the inlet 53 has provided therein an inducer 56 which is coupled to the rotating group for rotation therewith by a coupling 57 extending through coaxial center passages in the port plate and manifold.

In operation, the drive shaft 42 is rotated to rotate the barrel 16. As the barrel rotates, the pistons 23 are rotated therewith and will be caused to move back and forth within their respective cylinders 22 because the swash plate 30 (more particularly the cam surface 29 thereof) is tilted relative to the rotational axis 17 of the barrel. During the expansion stroke of the pistons, hydraulic fluid will flow into the cylinders from the inlet 53 that typically will be connected to the reservoir of a hydraulic system. In a closed hydraulic system {to which the present invention pertains) the reservoir will usually be at a pressure above atmospheric pressure such as, for example, 50–150 psi. During the contraction stroke of the pistons, hydraulic fluid will flow from the cylinders to the outlet 54 under high pressure such as, for example, 3000–8000 psi. The outlet pressure and/or rate of flow of hydraulic fluid through the pump may be varied by varying the rotational speed of the drive shaft 41 and/or by varying the tilt angle of the swash plate 30. In many systems it is desirable to vary the tilt angle of the swash plate to accommodate varying system demands while maintaining a constant system pressure.

When the pump 10 is operating, hydraulic fluid will leak from the rotating group 15 into the interior chamber 14 of the case 11 in which the rotating group rotates. Although leakage is often viewed as a negative, in the illustrated pump leakage is desirable and is designed into the rotating group to provide for lubrication and cooling of internal pump components. In this regard, the pistons and piston shoes 28 are provided with small hydraulic fluid passages 62 for allowing a small amount of hydraulic fluid to flow from the piston cylinders to the bottom surfaces of the piston shoes that slidably engage the end (or cam) face 29 of the wear plate 32 thereby to allow the piston shoes to slide with minimum friction on the end face of the wear plate.

The hydraulic fluid that leaks into the interior chamber 14 of the case is allowed to flow out of the case through a drain port (not shown) which will typically be connected to the reservoir of the hydraulic system. In a closed system, the interior chamber 14 of the case is "closed", i.e., not directly vented to atmosphere. Consequently, the interior chamber will fill with hydraulic fluid. In fact, in the illustrated pump this filling and fluid flow through the pump case is promoted by the provision of a connecting passage 65 between the inlet 53 and interior chamber 14 of the case and a case drain pump 67. The case drain pump is a gerotor that is drivingly connected to the drive shaft to pump hydraulic fluid from the interior chamber of the case out through a drain port (not shown) at a rate substantially greater than the leakage flow rate of the rotating group. That is, the case drain pump 67 and connecting passage 65 are provided to ensure a substantial quantity of flow through the interior chamber of the case primarily to enhance cooling of the pump. The case drain pump has an inlet port plate 69 and an outlet port plate 70, the latter discharging fluid into interior bore 71 to which the drain port (not shown) is connected.

As above indicated the interior chamber 14 of the case 11 will be full of hydraulic fluid. This provides resistance to rotation of the rotating group 15, i.e., windage losses, and a corresponding reduction in pump efficiency. Although these losses may necessarily have to be tolerated in a pump like that shown in FIG. 1 where a controlled rate of flow through the pump case is desired as for cooling, other applications do not require such controlled rate of flow yet still suffer from the windage losses associated with the case being full with hydraulic fluid. The present invention provides a solution to this problem, as opposed to the aforedescribed solution to the problem of providing a controlled rate of flow of hydraulic fluid through the case by use of a case drain pump.

Preferred Pump Embodiment (FIG. 2)

Referring now to FIG. 2, a rotating piston pump according to the present invention is indicated generally at 110. Although the pump differs in operating principle from the prior art pump of FIG. 1 in relation to the flow of fluid through the pump case, its construction is essentially the same except for the below indicated modifications that give rise to the novel features and advantages provided by the present invention. Accordingly, reference may be had to the above identified pump available from Abex Aerospace under Model No. AP19V-19 for details respecting construction and operation of the pump shown in FIG. 2 that are not specifically described herein, and also to a related pump sold by Abex Aerospace under Model No. AP19V-18.

Like the pump 10, the pump 110 comprises a case 111 which has a front section 112 and a rear section 113. The front and rear sections define therebetween a closed interior chamber 114 in which a rotating group 115 is located.

The rotating group 115 includes a barrel 116 that is mounted within the case 111 for rotation about its center axis 117 by suitable means. In the illustrated exemplary embodiment, the barrel is supported by the inner race 118 of a roller bearing 119 mounted in the case 111.

The barrel 116 has formed therein a plurality of bores 122 that form cylinders for reciprocating pistons 123. As shown, the axes of the cylinders 122 and pistons are parallel to the rotational axis 117 of the barrel. The rear ends of the pistons 123 have balls 126 which are received in sockets of shoes 128, whereby the shoes can swivel relative to the pistons. The piston shoes are held to an end face 129 of a swash plate 130 by a retainer assembly 131. In the illustrated pump 110, the swash plate is formed by a wear plate 132 supported on a hanger 133. The wear plate 132 is retained against the front end of the hanger by the retainer assembly 131.

The hanger 133 is mounted in the case 111 by a pair of trunnion bearings 136 and 137. The trunnion bearings prevent the hanger from rotating with the rotating group 115 while enabling the hanger to swivel about an axis perpendicular to the rotation axis 117 of the rotating group 115. The cant or tilt of the hanger, or more particularly the end face 129 of the swash plate 130, is controlled by a stroking piston that is not shown because it is offset from the plane of the cross-section shown in FIG. 2.

The swash plate 130 has a center through passage through which a drive shaft 141 extends coaxially with the barrel 116. The drive shaft 141 is connected to the barrel 116 and extends through an opening 143 in the rear end wall 144 of the case. The drive shaft is rotatably supported by a bearing 146 and the opening 143 is closed and sealed with respect to the drive shaft by a seal 147. The seal 147 is formed by an assembly of parts that provide a dynamic seal between the case and the rotating shaft. At its outer end the drive shaft is provided with a drive coupling 142 that forms a continuation of the drive shaft and provides for connection to an external device such as a motor.

At the other end of the case 111 opposite the drive shaft 141, there is provided a port plate 150 and a manifold 151 which directs the flow of fluid between the piston cylinders 122 in the barrel and an inlet 153 and outlet 154. More particularly, the passages in the port plate and manifold direct fluid from the inlet 153 to each cylinder during an expansion stroke of the associated piston and from the cylinder to the outlet 154 during the contraction stroke of the piston, thereby to effect pumping of fluid from the inlet to the outlet. As shown, the inlet 153 has provided therein an inducer 156 which is coupled to the rotating group for rotation therewith by a coupling 157 extending through coaxial center passages in the port plate and manifold.

In operation, the drive shaft 141 is rotated to rotate the barrel 116. As the barrel rotates, the pistons 123 are rotated therewith and will be caused to move back and forth within their respective cylinders 122 because the swash plate 130 is tilted relative to the rotational axis 117 of the barrel. During the expansion stroke of the pistons, fluid will flow into the cylinders from the inlet 153 that typically will be connected to the reservoir of a hydraulic system. In a closed hydraulic system (to which the present invention pertains) the reservoir will usually be at a pressure above atmospheric pressure such as, for example, 50–150 psi. During the contraction stroke of the pistons, fluid will flow from the cylinders to the outlet 154 under high pressure such as, for example, 3000–8000 psi. The outlet pressure and/or rate of flow of fluid through the pump may be varied by varying the rotational speed of the drive shaft and/or by varying the tilt angle of the swash plate. As previously indicated, in many systems it is desirable to vary the tilt angle of the swash plate to accommodate varying system demands while maintaining a constant system pressure.

When the pump 110 is operating, fluid will leak from the rotating group 115 into the interior chamber 114 of the case 111 in which the rotating group rotates. The pistons and piston shoes are provided with small fluid passages 162 for allowing a small amount of fluid to flow from the piston cylinders to the bottom surfaces of the piston shoes 128 that slidably engage the end (or cam) face 129 of the wear plate 132 thereby to allow the piston shoes to slide with minimum friction on the end surface of the wear plate.

In accordance with the invention, only leakage and/or otherwise metered flow of hydraulic fluid is allowed to flow into the interior chamber 114 of the case 111 in which the rotating group 115 rotates. Although the interior chamber is "closed", i.e., not directly vented to the atmosphere, the interior chamber during operation will not fill with hydraulic fluid by reason of there being provided a scavenger pump 170 that preferably is a hydrostatic or positive displacement pump. Moreover, the case is provided with a sump 171 at the bottom of the interior chamber for accumulating a volume of fluid and from which fluid is pumped out of the interior chamber by the scavenger pump 170. The sump 171 is formed in the illustrated embodiment by spacing the bottom wall 172 of the case 111 further from the rotating group 115 than the top and side walls of the case, thereby to provide a space for accumulation of hydraulic fluid outside the cylindrical envelope of the rotating group.

In the illustrated preferred embodiment, the scavenger pump 170 is a gerotor having an inlet port plate 175 and an outlet port plate 176. The inlet port plate is disposed on the interior chamber side of the scavenger pump and has a scavenger pump inlet port 178 connected to a flow passage 179 in the bottom wall 172 of the case that is connected to the sump at a point beneath the rotating group and consequently outside the cylindrical envelope of the rotating group. The outlet port plate 176 is disposed on the shaft seal side of the scavenger pump and is provided in conventional manner with an outlet port (not shown) connected to the case drain outlet 181 via interior bore 183 which houses the bearing 146.

The scavenger pump 170 is drivingly connected to the drive shaft 14 and, according to the invention, has a pumping capacity greater than the flow rate at which fluid leaks or otherwise is metered into the interior chamber 114. In relation to the above described pump 10, there is no passage 65 (FIG. 1) connecting the inlet 153 to the interior chamber 114 or if such a passage is provided it is of sufficiently small size or provided with a metering orifice such that the combined rate of flow of fluid into the interior chamber does not exceed the pumping capacity of the scavenger pump.

Accordingly, during operation of the pump 110, the closed interior chamber 114 of the case 111 is scavenged because the scavenge pump's discharge flow capability is greater than the rate at which fluid leaks or otherwise is metered into the interior chamber. This reduces the pressure in the interior chamber and causes air in the fluid to come out of solution. This air collects in the interior chamber while the quantity of fluid decreases. As the pressure decreases, the efficiency of the scavenge pump decreases until the flow rate of the scavenge pump equals the rate that fluid leaks or otherwise is metered into the interior chamber of the case. The pump case is scavenged at this condition and preferably the level of fluid in the scavenged case is maintained below the rotating group so as to minimize windage losses and thereby increase the efficiency of the pump.

The pressure in the scavenged pump will typically drop below atmospheric (ambient) pressure. Notwithstanding, ingestion of air into the interior chamber 114 is prevented in the illustrated embodiment by the positioning of the scavenger pump 170 such that the dynamic seal 147 for the drive (input) shaft 141 is in a high pressure region 183 of the case. As above indicated, the dynamic shaft seal 147 is on the output or high pressure side of the scavenger pump, thereby precluding ingestion of air through the dynamic shaft seal. As discussed further below, ingestion of air may be otherwise avoided as by incorporation of the pump into a functional package without dynamic seals.

Because of the low pressure in the case and usually high operating speeds, the fluid leaking into the interior chamber of the case will usually form a foam. Preferably, the sump is sized such that the fluid can settle out of the foam in the sump beneath the rotating group prior to being scavenged from the case.

Further in accordance with the invention, a check valve 186 is provided in the scavenge pump outlet 181. This blocks fluid from back filling the case during periods when the pump is not being operated. If the case fills with fluid when not being operated, the pump will upon start-up operate at a lower efficiency until the pump case is once again scavenged.

As will be appreciated by those skilled in the art, the aforedescribed pump 110 may be modified in various respects without deviating from the invention and the invention may be applied to other types of pumps than that herein shown. For example, the rotating group 115 may include a single piston although preferably a plurality of pistons. Also, the various components may appear in different forms. The swash plate 130, for example, may take various forms and may be disposed at a fixed tilt angle as in a fixed displacement-type pump, and the pistons 123 may assume a variety of configurations as many are well known in the art. Additionally, the scavenger pump 170 may be of a type other than a gerotor, although the latter is preferred.

The invention may also be practiced with rotating elements other than the illustrated rotating piston group, thereby to reduce windage losses associated with the rotating element rotating through a case full of hydraulic fluid. For example, the pump of FIG. 2 may be reconfigured to provide for rotation of the swash plate (as the rotating element) while the barrel is retained in the housing against rotation with the swash plate, or other similarly functioning device.

Although the invention has been described primarily in relation to a fluid pump, the invention as above described is equally applicable to a fluid motor that includes a rotating element, such as a rotating piston group, that rotates in a closed chamber of a case that heretofore has been filled with hydraulic fluid. Instead of the pistons be driven mechanically to pump fluid, pressurized fluid is supplied to power the pistons to effect rotation of the rotating element which rotation is outputted by suitable means such as an output shaft. In the context of the above described pump structure, fluid may be sequentially supplied and exhausted from the piston cylinders 122 to drive the pistons 123 against the swash plate 130 with reactionary forces generating a torque applied to the barrel 116. This torque will rotate the barrel and consequently the shaft 141.

Figure 3:
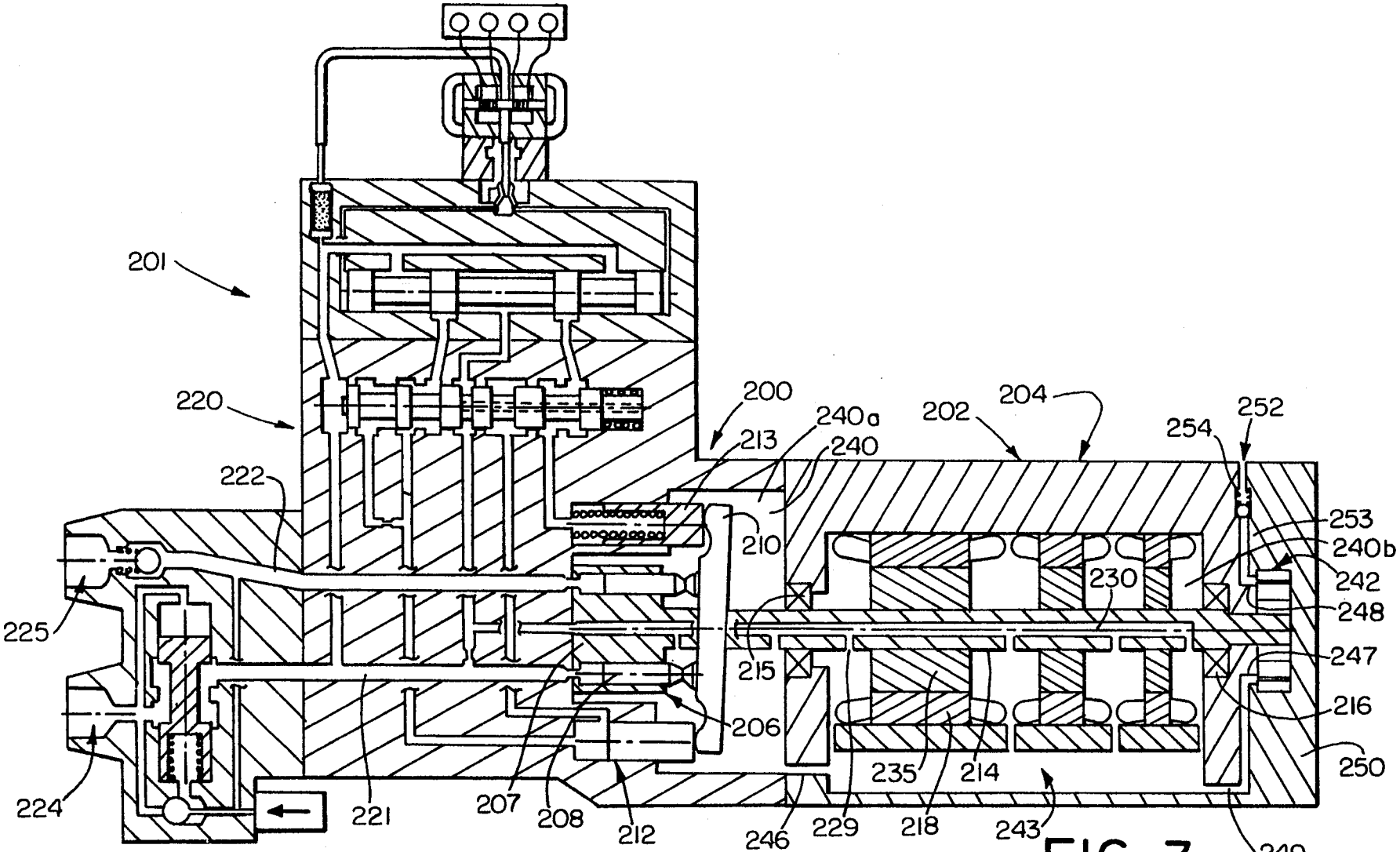
FIG. 3 is a diagrammatic view of a rotating piston motor packaged with a generator in accordance with the present invention.

Fluid Motor And Generator Embodiment (FIG. 3)

Referring now to FIG. 3, a fluid motor according to the invention is diagrammatically shown. In this embodiment of the invention, the fluid motor 200 is integrated into a package 201 with a generator 202 driven by the motor, i.e., the motor and generator share a common case 204.

The fluid motor 200 comprises a rotating group 206 that includes a barrel 207 that is mounted within the case 204 for rotation about its axis. The barrel 207 has formed therein a plurality of bores that form cylinders for reciprocating pistons 208. As shown, the axes of the cylinders and pistons are parallel to the rotational axis of the barrel. The rear ends of the pistons are provided with piston shoes that engage an end face of a swash plate 210.

The swash plate 210 is mounted in the case so that it can swivel about an axis perpendicular to the rotation axis of the rotating group 206. The cant or tilt of the swash plate, or more particularly the cam face of the swash plate, is controlled by a stroking piston or pistons 212 and 213.

The swash plate 210 has a center through passage through which a drive shaft 214 extends coaxially with the barrel 207. The drive shaft is rotatably supported by bearings 215 and 216 and, at its end remote from the fluid motor, forms the rotor shaft of the generator. The generator 202 also includes a stator 218 mounted in the case. In the illustrated embodiment, there are actually three rotors and stators forming three power groups.

At the left in FIG. 3, fluid circuitry and associated components are illustrated and generally indicated by reference numeral 220. The circuitry 220 provides various control functions that allow the illustrated motor and generator package 201 to operate in a stand-by as well as a normal operating mode. The operational modes and the details and operation of the circuitry do not form a part of the present invention, aside from there being provided supply and return passages 221 and 222 for delivering and removing fluid to and from the piston cylinders via suitable ports for effecting rotation of the barrel 207. Fluid is directed from an inlet 224 to each cylinder during an expansion stroke of the associated piston and from the cylinder to an outlet 225 during the contraction stroke of the piston, thereby to effect flow of fluid from the inlet to the outlet. Additionally it is noted that the illustrated hydraulic circuitry includes fluid lines and components for controlling the tilt angle of the swash plate 210, and it can also be seen that provision is made for spray cooling of the generator by means of spray ports 229 supplied with fluid via a passage 230 in the shaft.

In operation, pressurized fluid is supplied to power the pistons 208 to effect rotation of the rotating group 206 which rotation rotates the shaft 230 to turn the rotor(s) 235 of the generator 202. Fluid is sequentially supplied and exhausted from the piston cylinders to drive the pistons against the swash plate with reactionary forces generating a torque applied to the barrel. This torque will rotate the barrel and consequently the shaft.

When the motor is operating, fluid will leak from the rotating group into the interior chamber 240 of the case in which the rotating group rotates. As above described in connection with the pump of FIG. 2, the leakage is desirable and is designed into the rotating group to provide for lubrication and cooling of internal pump components. Preferably, the pistons and piston shoes are provided with small fluid passages for allowing a small amount of fluid to flow from the piston cylinders to the bottom surfaces of the piston shoes that slidably engage the end or cam face of the swash plate thereby to allow the piston shoes to slide with minimum friction on the end surface of the swash plate.

Although the interior chamber 240 is closed, i.e., not vented to the atmosphere, the interior chamber will not fill with hydraulic fluid by reason of there being provided a scavenger pump 242. Moreover, the case is provided with a sump 243 at the bottom of the interior chamber for accumulating a volume of fluid and from which fluid is pumped out of the interior chamber by the scavenger pump. In the illustrated embodiment, the closed interior chamber is formed by two compartments **240*a* and 240*b* interconnected by a connecting passage 246 or other means providing for communication between the chambers in a closed package. The compartments 240*a* and 240*b* respectively house the rotating group 206 and the rotor and stator of the generator. As shown, the sump 243 is formed at the bottom of the generator compartment or portion 240*b* of the closed interior chamber 240** for accumulation of hydraulic fluid outside the generator envelope.

The scavenger pump 242 preferably is a hydrostatic pump such as a gerotor having an inlet port 247 and an outlet port 248. The inlet port 247 is connected by a flow passage 249 in the end wall 250 of the case to the sump. The outlet port 248 is connected to the case drain outlet 252 by a passage 253 provided with a check valve 254 to prevent back flow of hydraulic fluid into the interior chamber when the motor is not being operated.

The scavenger pump 242 is drivingly connected to the drive shaft 214 and, according to the invention, has a pumping capacity greater than the flow rate at which fluid leaks or otherwise is metered into the interior chamber 240. Accordingly, during operation of the motor, the interior chamber of the case is scavenged because the scavenge pump's discharge flow capability is greater than the rate at which fluid leaks or otherwise is metered into the interior chamber. This reduces the pressure in the case and causes air in the fluid to come out of solution. This air collects in the case while the quantity of fluid decreases. As the pressure in the case reduces, the efficiency of the scavenge pump decreases until the flow rate of the scavenge pump equals the rate that fluid leaks or otherwise is metered into the interior chamber of the case. The package case is scavenged at this condition and preferably the level of hydraulic fluid in the scavenged case is maintained below the rotating group and the rotor(s) and stator(s) of the generator so as to minimize windage losses and thereby increase the efficiency of the motor and generator package.

The pressure in the scavenged case will typically drop below atmospheric (ambient) pressure. However, this in not a problem in the illustrated packaged arrangement as no dynamic seal is required for the shaft inasmuch as the generator is packaged in the case along with the fluid motor.

As will be appreciated by those skilled in the art, in a manner similar to that just described, a pump and an electric motor driving the pump may be packaged together to avoid the need for a dynamic seal exposed at one side to the atmosphere.

Although the invention has been shown and described with respect to several preferred embodiments, equivalent alterations and modifications will of course occur to others skilled in the art upon the reading and understanding of this specification. The present invention includes all such equivalent alterations and modifications, and is limited only by the scope of the following claims.

What is claimed is:

1. A fluid device comprising a case having a closed chamber, a rotating element mounted for rotation within said closed chamber, a reciprocating piston drivingly connected to said rotating element such that rotation of said rotating element corresponds to reciprocating movement of said piston, means for admitting and discharging fluid to and from a cylinder in which said piston reciprocates, at least one path for flow of fluid into said closed chamber all fluid entering said closed chamber collectively at a first rate, and a scavenger pump drivingly connected to said rotating element and operable to pump fluid out of said closed chamber at a second rate greater than said first rate, thereby to maintain the level of fluid within said closed chamber below a predetermined level.

2. A fluid device as set forth in claim 1, including a shaft connected to said rotating element, said shaft extending through an opening in a wall of said case.

3. A fluid device as set forth in claim 2, wherein said scavenger pump has an inlet side and an outlet side, said scavenger pump is located between said closed chamber and said opening in said wall of said case, and said opening is on said outlet side of said scavenger pump and said closed chamber is on said inlet side of said scavenger pump.

4. A fluid device as set forth in claim 1, wherein said rotating element includes a barrel having said cylinder in which said piston is mounted for reciprocating movement.

5. A fluid device as set forth in claim 4, comprising a swash plate member, and said piston having means engaging said swash plate member.

6. A fluid device as set forth in claim 1, wherein said case has a sump at the bottom of said closed chamber for collecting a quantity of said fluid, and a fluid passage is provided to connect said sump to an inlet of said scavenger pump.

7. A fluid device as set forth in claim 1, wherein said scavenger pump is a hydrostatic pump.

8. A fluid device as set forth in claim 1, wherein said at least one path for flow of fluid into said closed chamber includes a leakage path in association with said piston.

9. A fluid device as set forth in claim 1, in combination with an electrical device, said electrical device including a rotating element enclosed within said case and drivingly connected to said rotating element within the confines of said closed chamber.

10. A combination as set forth in claim 9, wherein said electrical device includes a stator and a rotor, said rotating element of said electrical device including said rotor, and said stator and rotor being enclosed within said case.

11. A fluid pump comprising a case having a closed chamber, a rotating element mounted for rotation within said closed chamber, a drive shaft connected to said rotating element, a reciprocating piston drivingly connected to said rotating element such that rotation of said rotating element corresponds to reciprocating movement of said piston within a cylinder, means for admitting and discharging fluid to and from said cylinder in which said piston reciprocates, at least one path for flow of fluid into said closed chamber, all fluid entering said closed chamber collectively at a first rate, and a scavenger pump drivingly connected to said rotating element and operable to pump fluid out of said closed chamber at a second rate greater than said first rate, thereby to maintain the level of fluid within said closed chamber below a predetermined level.

12. A fluid pump as set forth in claim 11, wherein said drive shaft extends through an opening in a wall of said case, said scavenger pump has an inlet side and an outlet side, said scavenger pump is located between said closed chamber and said opening in said wall of said case, and said opening is on said outlet side of said scavenger pump and said closed chamber is on said inlet side of said scavenger pump.

13. A fluid pump as set forth in claim 11, wherein said case has a sump at the bottom of said closed chamber for collecting a quantity of said fluid, and a fluid passage is provided to connect said sump to an inlet of said scavenger pump.

14. A fluid pump as set forth in claim 11, wherein said at least one path for flow of fluid into said closed chamber includes a leakage path in association with said piston.

15. A fluid pump as set forth in claim 11, in combination with an electrical device, said electrical device including a rotating element enclosed within said case and drivingly connected to said drive shaft within the confines of said closed chamber.

16. A fluid motor comprising a case having a closed chamber, a rotating element mounted for rotation within said closed chamber, an output shaft connected to said rotating element, a reciprocating piston drivingly connected to said rotating element such that reciprocating movement of said piston effects rotation of said rotating element, means for admitting and discharging fluid to and from a cylinder in which said piston reciprocates for effecting reciprocating movement of said piston, at least one path for flow of fluid into said closed chamber, all fluid entering said closed chamber collectively at a first rate, and a scavenger pump drivingly connected to said rotating element and operable to pump fluid out of said closed chamber at a second rate greater than said first rate, thereby to maintain the level of fluid within said closed chamber below a predetermined level.

17. A fluid motor as set forth in claim 16, wherein said output shaft extends through an opening in a wall of said case, said scavenger pump has an inlet side and an outlet side, said scavenger pump is located between said closed chamber and said opening in said wall of said case, and said opening is on said outlet side of said scavenger pump and said closed chamber is on said inlet side of said scavenger pump.

18. A fluid motor as set forth in claim 16, wherein said case has a sump at the bottom of said closed chamber for collecting a quantity of said fluid, and a fluid passage is provided to connect said sump to an inlet of said scavenger pump.

19. A fluid motor as set forth in claim 16, wherein said at least one path for flow of fluid into said closed chamber includes a leakage path in association with said piston.

20. A fluid motor as set forth in claim 16, in combination with an electrical device, said electrical device including a rotating element enclosed within said case and drivingly connected to said output shaft within the confines of said closed chamber.

* * * * *